US005425535A

United States Patent [19]

Gee

[11] Patent Number: 5,425,535

[45] Date of Patent: Jun. 20, 1995

[54] POLYMER FILLED PERIMETER WEIGHTED GOLF CLUBS

[75] Inventor: Michael W. Gee, Boise, Id.

[73] Assignee: Flagler Manufacturing, Inc., Boise, Id.

[21] Appl. No.: 278,379

[22] Filed: Jul. 20, 1994

[51] Int. Cl.[6] ..... A63B 53/04

[52] U.S. Cl. ..... 273/78; 273/167 J; 273/173

[58] Field of Search ..... 273/167 H, 78, 173, 273/167 F, 167 J, 167 A, 167 D, 167 G, 175, 169

[56] References Cited

U.S. PATENT DOCUMENTS 4,252,262 2/1981 Igarashi ..... 228/174

4,928,972 5/1990 Nakanishi et al. ..... 273/78

*Primary Examiner*—Vincent Millin

*Assistant Examiner*—Steven B. Wong

*Attorney, Agent, or Firm*—Korfanta & Dunbar

[57] ABSTRACT

A perimeter weighted golf club head having a flush mounted polymer insert in the club face which is approximately centered coaxially with the center of mass of the golf club head and a cavity filler. A recess for the polymer insert is either formed in the main body structure of the golf club head during the casting process, or subsequently by machining. A retainer is provided to help secure the insert and cavity filler in both the club face recess and the hollow cavity. The retainer can take the form of a through hole connecting the recess to the hollow cavity and/or lip surrounding either or both the recessed insert opening and the cavity opening.

8 Claims, 9 Drawing Sheets

POLYMER FILLED PERIMETER WEIGHTED GOLF CLUBS

BACKGROUND OF THE INVENTION

1. Technical Field.

This invention generally relates to golf clubs and more particularly, this invention relates to a perimeter weighted or cavity-backed golf clubs having both a polymer-filled hitting surface, and a polymer filled cavity.

2. Background

One of the more recent and significant developments in golf club technology is the perimeter weighted club. The theory behind the perimeter weighting of golf club heads is to increase the mass moment of inertia and thereby reduce the tendency of the club head to twist about the center of percussion during an off-center hit. An off-center hit is one in which contact with the ball is made at a point not lying in a vertical plane containing the center of mass of the golf club head. The practical effect of increasing the mass moment of inertia of the club head is to reduce, by a few degrees, the tendency to slice or hook with an off-center hit. Additionally, because less energy is lost in twisting the perimeter weighted club head about the center of percussion, the golf ball will tend to fly further when hit off center with a perimeter weighted club than it would when hit off center with a forged or blade type club head. For the average amateur golfer who does not consistently contact the ball at the "sweet spot", there is a very real improvement in distance and accuracy.

However, a substantial number of fairly proficient golfers, that is golfers who mostly hit at or near the sweet spot of the club head, would prefer to sacrifice small deviations from the intended target line and distance on their shot in order to better "feel" the off-center shot. As a result, a significant number of low handicap golfers golf with forged/blade type club heads as opposed to perimeter weighted/cavity backed club heads.

Therefore, it would be desirable to provide a golf club which exhibited all of the benefits of the higher mass moment of inertia perimeter weighted clubs without sacrificing the "feel" of a lower mass moment of inertia club, such as the forged/blade type clubs.

DISCLOSURE OF INVENTION

This need, and others, is satisfied by a perimeter weighted cavity backed club which includes a polymer filled recess and a polymer insert in the cavity back. This invention applies to both irons and to what are referred to as woods, even though it is more common to manufacture the woods out of metal or synthetic materials exhibiting similar properties. For the purposes of this disclosure, the construction of golf club irons is explained and illustrated. However, the principals apply equally well to both irons and woods, with the only difference being that it is traditional to have a hollow cavity which is enclosed within a wood as opposed to having an open cavity on the back of an iron.

Standard perimeter weighted cavity backed irons presently come in various configurations, sizes and shapes. Design parameters include loft and lie angles, no hosel offset, constant hosel offsets, progressive hosel offsets, flat club soles, radiused club soles, progressive heel to toe weighting, and varying the sole angle from a bounce or inverted sole to a square sole to a scoop or dig sole.

Generally speaking, all perimeter weighted golf clubs include a hosel for connecting the golf club head to a golf club shaft, a golf club face to provide a striking surface for contacting a golf ball, and a heel, sole and toe, all surrounding the club face. Perimeter weighting is accomplished by concentrating a large percentage of the mass around the outer marginal edge of the back of the club face by forming bosses extending from the back of the club face, where the boss extending rearward from the sole is generally thickest, the boss extending from the back of the toe being the next thickest, and the boss extending from the top of the toe to the hosel being the least thickest.

Conceptually, the invention includes a flush mounted polymer insert in the club face which is approximately centered coaxially with the center of mass of the golf club head. Ideally, the insert is symmetrical and colored and shaped to help the golfer visualize a target area on the club face for contact with a golf ball. A recess for the polymer insert is either formed in the main body structure of the golf club head during the casting process, or subsequently by machining. Because the polymer insert which fills the recess is less dense than the metal material which would have filled the recess, providing the flush mounted polymer insert and the club face actually increases the mass moment of inertia of the golf club. However, to give the club a more solid feel at impact, an additional mass of polymer material is added, which at least partially offsets the gain in the mass moment of inertia of the club head. A retainer is provided to help secure the insert and polymer mass cavity filler in both the club face recess and the hollow cavity. The retainer can take the form of a through hole connecting the recess to the hollow cavity and/or lip surrounding either or both the recessed insert opening and the cavity opening.

Additionally, ideally the polymer material is an epoxy or similar formable polymer which exhibits positive adherence characteristics to the main body structure of the club head. In the current preferred embodiment, once the main body structure of the golf club head has been formed, such as by investment casting, the intermediate piece is put in a second mold for casting the club face insert and cavity filler by injecting epoxy into the mold to fill the recess and hollow cavity. While the actual type and make up of the material used for the insert and cavity filler is not critical, it must exhibit the properties of resiliency and elasticity. Consequently, other types of materials could be substituted for the epoxy.

BEST MODE FOR CARRYING OUT INVENTION

Figure 1:
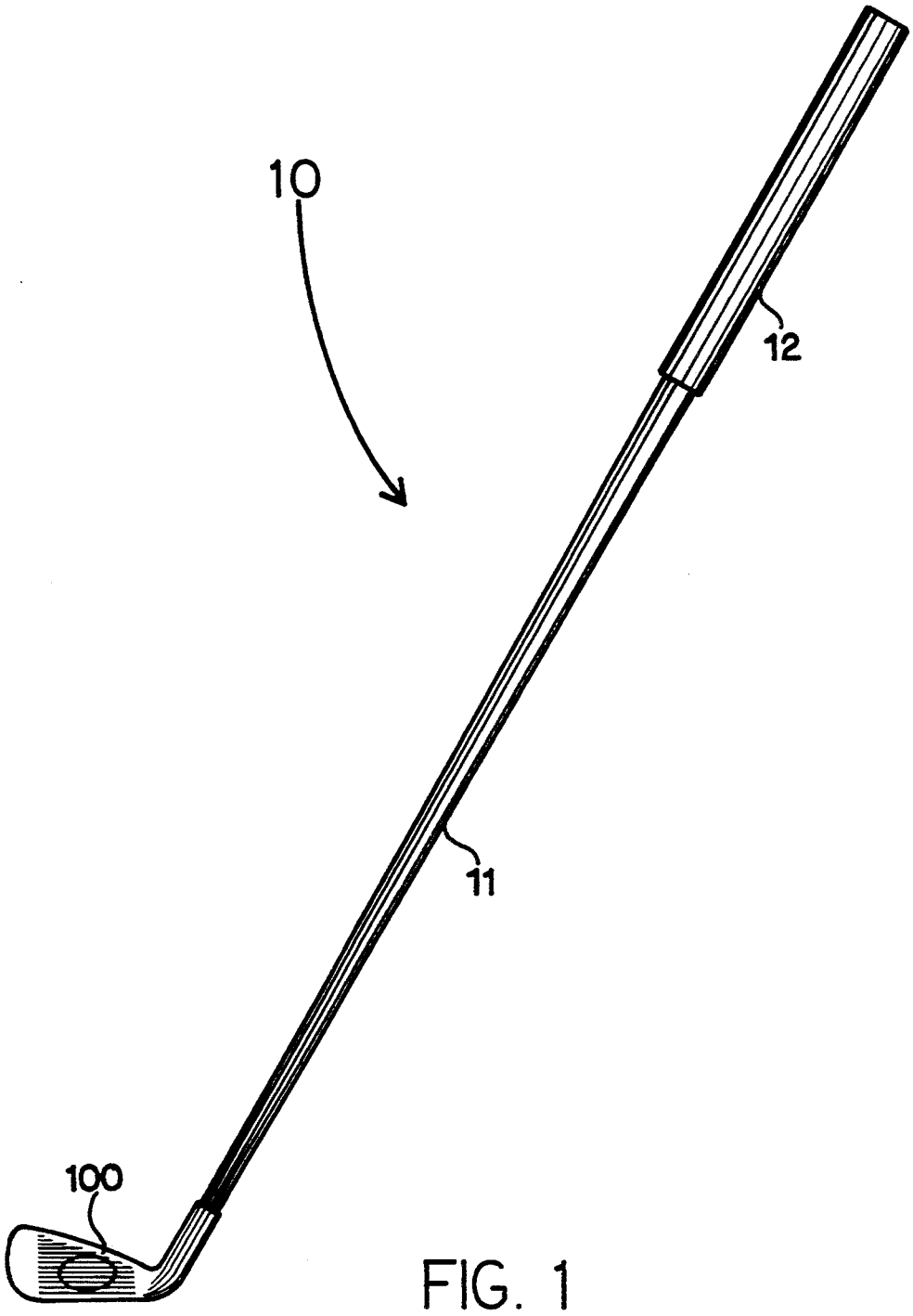
FIG. 1 is a front view of a golf club employing a golf club iron head made in accordance with the principals of the present invention.
Figure 2:
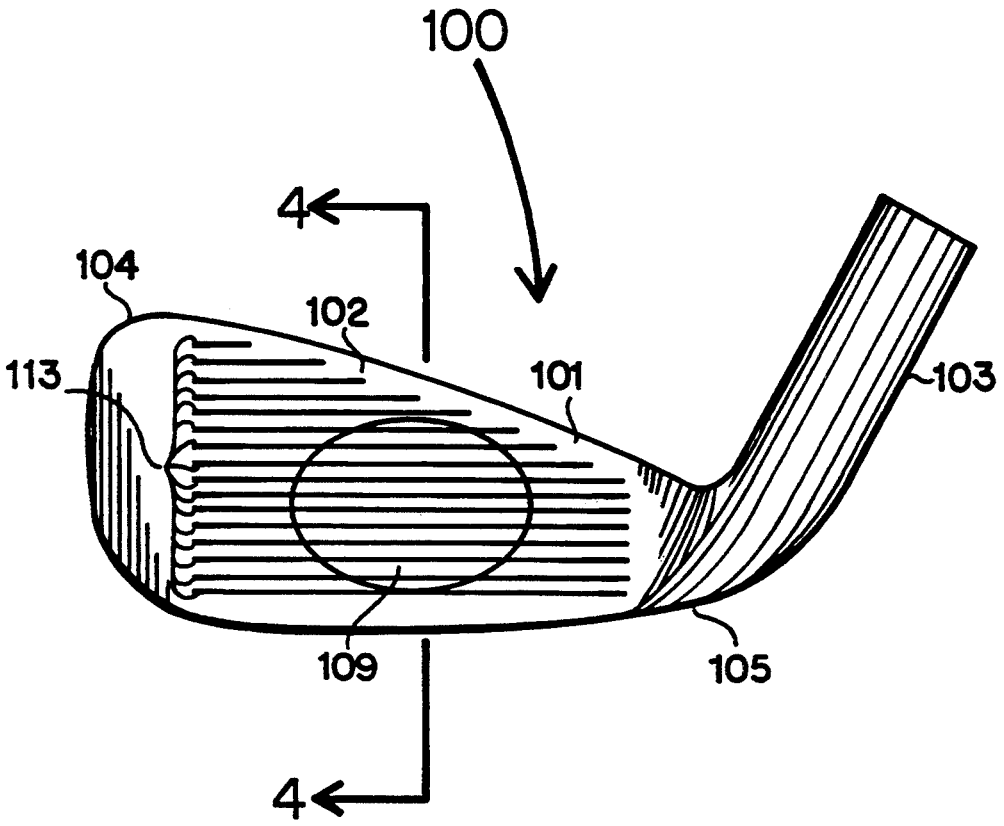
FIG. 2 is a front detailed view of the golf club head of FIG. 1.
Figure 3:
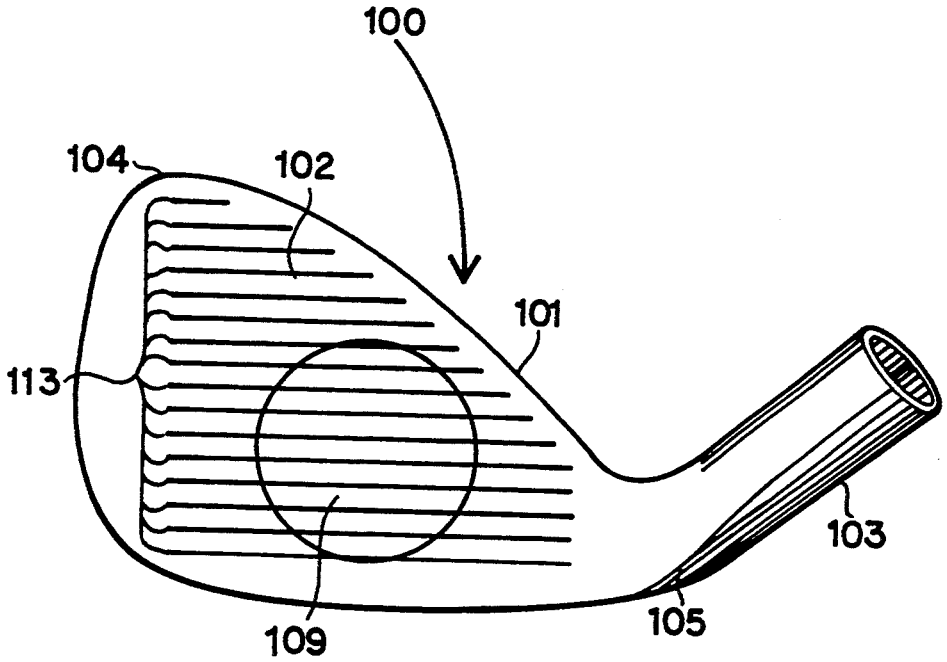
FIG. 3 is a front elevation view of the golf club head of FIG. 1 taken from a perspective normal to the face of the golf club head.

Referring now to the figures, a polymer filled perimeter weighted golf club iron head 100 is shown in detail with golf club being generally designated as 10. Golf Club 10 generally includes a standard shaft 11, normally manufactured of steel or a similar composite material, to which a grip 12 is attached at the upper end of shaft 11 and to which club head 100 is attached at the lower end of shaft 11.

Club head 100 in this preferred embodiment, includes a main body structure 101 having a tubular hosel 103 extending upwardly from the heel portion 105 of main body structure 101, the hosel being configured to receive and frictionally engage the lower end of shaft 11. Typically, shaft 11 and hosel 103 are rigidly connected together using a combination of a strong adhesive, such as epoxy, and some type of set screw.

Main body structure 101 is here manufactured from stainless steel, or another similar resilient hard material, using conventional techniques such as investment casting. However, it should be noted that this invention can be applied to virtually any perimeter weighted golf club construction. Main body 101 further has a substantially flat club face 102 which forms a forward facing striking surface for contacting a golf ball. A plurality of grooves 113 are formed within club face 102 in parallel spaced apart relation. Main body structure 101 also includes a toe portion 104 which is generally wider than, and positioned opposite to, heel portion 105. Toe portion 104 and heel portion 105 are connected at the bottom of club face 102 by the club sole. As previously mentioned, club sole can be substantially flat as shown in the attached drawings or can be radiused. Similarly, toe portion 104 and heel portion 105 are connected by a top edge of club face 102 which can be either flat or radiused and generally slopes upward from heel portion 105 to toe portion 104.

Perimeter weighting of the golf head club 100 is accomplished by concentrating a large percentage of the mass which constitutes the club head around and behind the outer marginal edges of club face 102. This can be accomplished by forming bosses 106 which extend rearwardly from the back of club face 102 in a generally triangular shape to form a hollow cavity in the back of club head 100, hence the name "cavity backed." The lower boss 106 which extends rearwardly from the sole is generally thickest, while the boss 106 extending from the back of toe portion 104 is the next thickest, and the boss 106 extending from the top of the toe portion 104 to hosel 103 being the least thickest.

A recessed portion 108 is formed in club face 102 to accept filler material 109. Recessed portion 108, depending on its shape, is approximately centered such that its center is coaxial with a line passing through the center of mass of club head 100. In this manner, both the recessed portion 108 and the insert which is formed within recessed portion 108 can approximate and indicate the "sweet spot" of golf club head 100.

Figure 7:
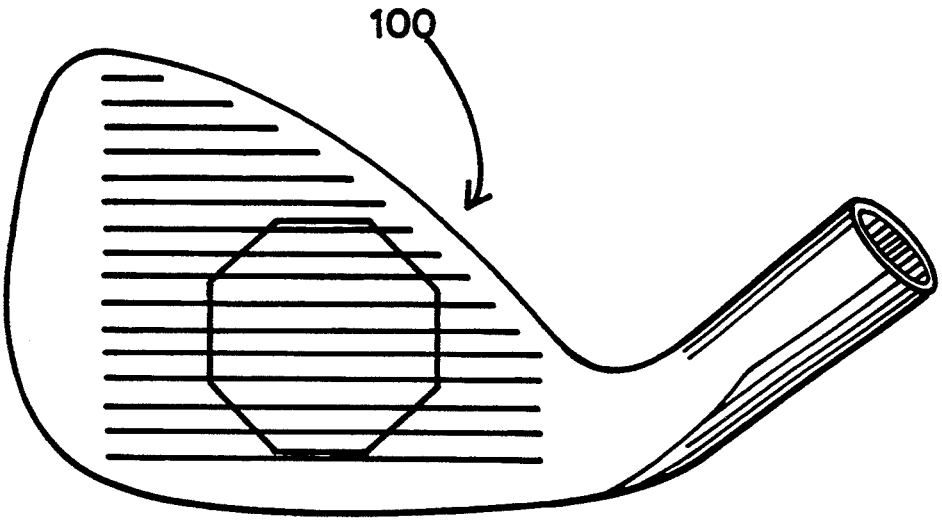
FIG. 7 is a simplified, but substantially identical view to that of FIG. 2, showing an alternate shape of the club head insert to advantage.
Figure 8:
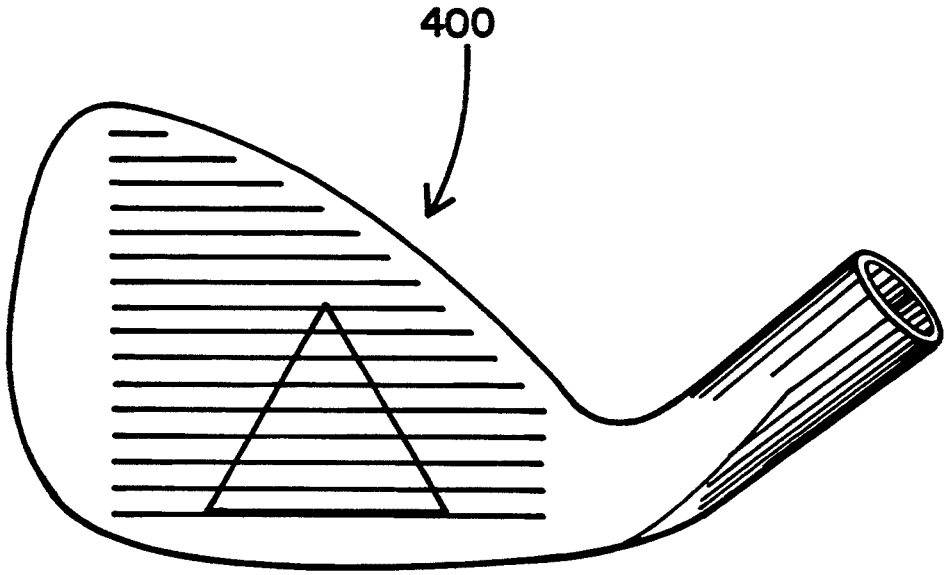
FIG. 8 is a similar view to that of FIG. 7 illustrating a second alternate shape for the club face insert.
Figure 9:
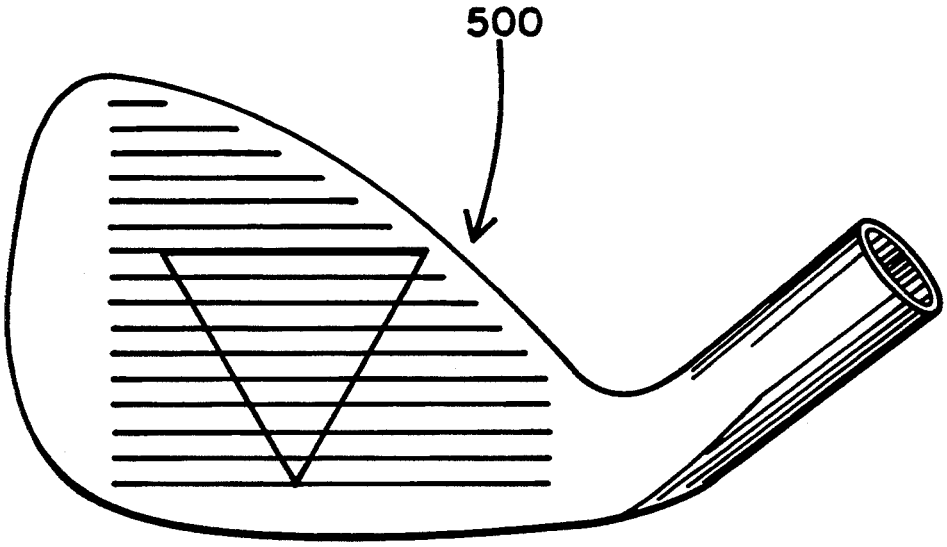
FIG. 9 is a similar view to that of FIG. 7 showing a third alternate shape for the club face insert.
Figure 10:
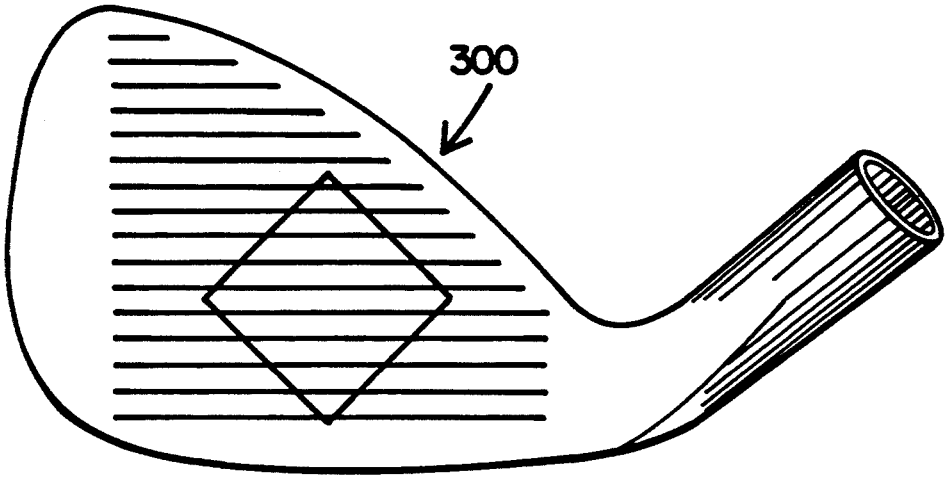
FIG. 10 is a similar view to that of FIG. 7 showing a fourth alternate shape for the club face insert.

Recessed portion 108 can be shaped in many different configurations, with symmetrical shapes currently being preferred. For example, FIGS. 1, 2, 3, 14 and 15 illustrate a circular insert formed as a result of a circular recessed portion 108. FIG. 7 illustrates an alternate embodiment 200 having a regular polyhedron shaped insert, shown here as an octagon. FIG. 8 depicts another alternate embodiment 400 having a right side up triangular insert. FIG. 9 shows another alternate embodiment 500 having an upside down triangular insert. FIG. 10 illustrates yet another embodiment 300 having a diamond shaped insert. Other symmetrical shapes could include squares, rectangles, ellipses and even free form shapes.

Figure 11:
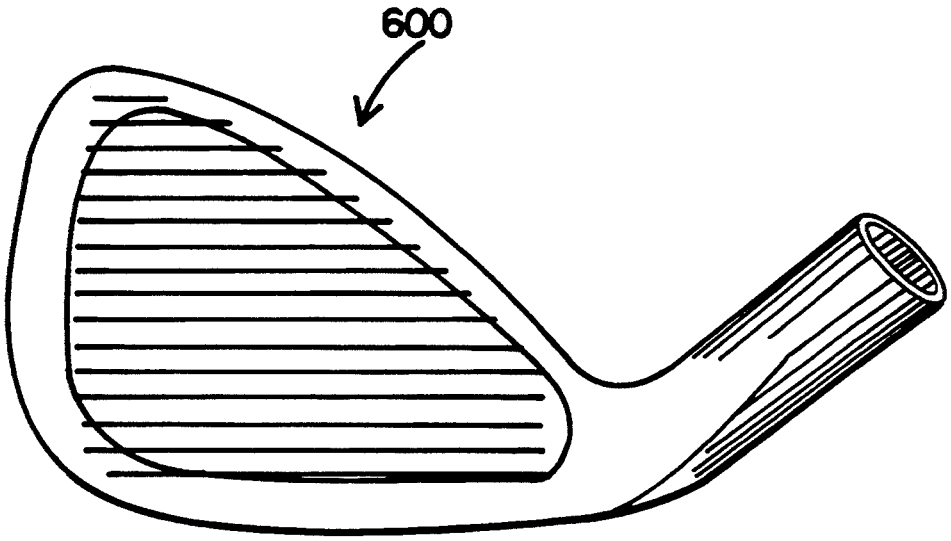
FIG. 11 is a similar view to that of FIG. 7 showing a fifth alternate shape for the club face insert.
Figure 12:
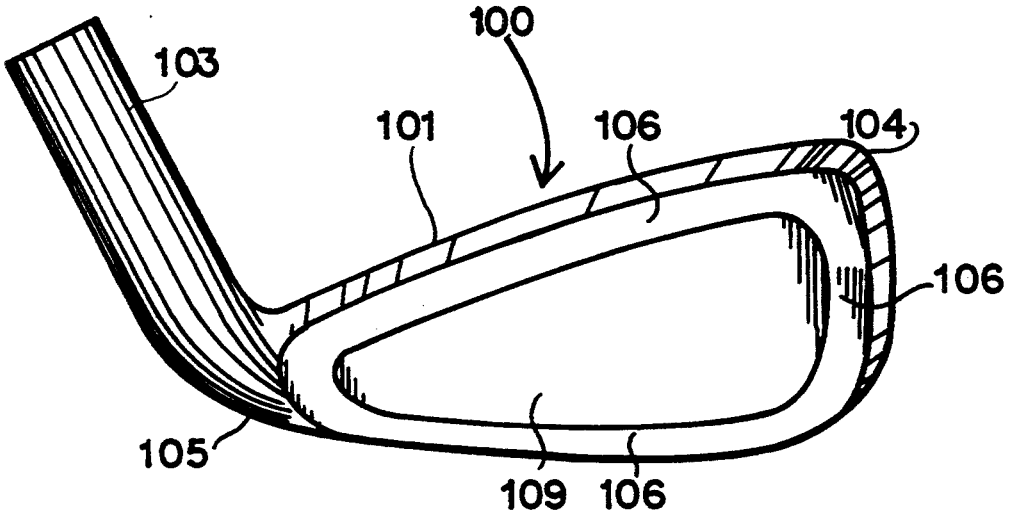
FIG. 12 is a back view of the golf club head.
Figure 13:
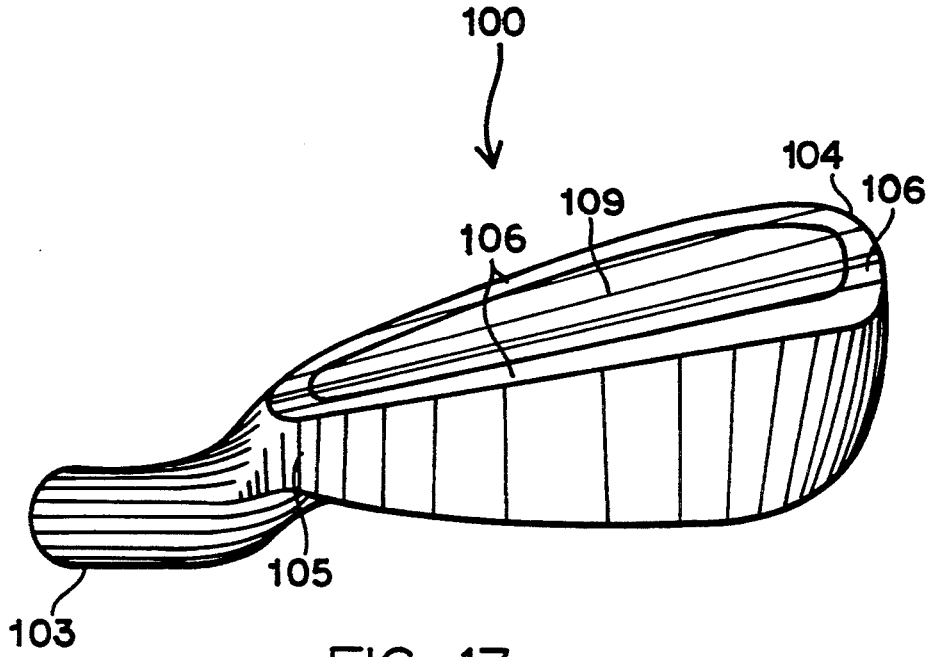
FIG. 13 is a bottom view of the golf club head.
Figure 14:
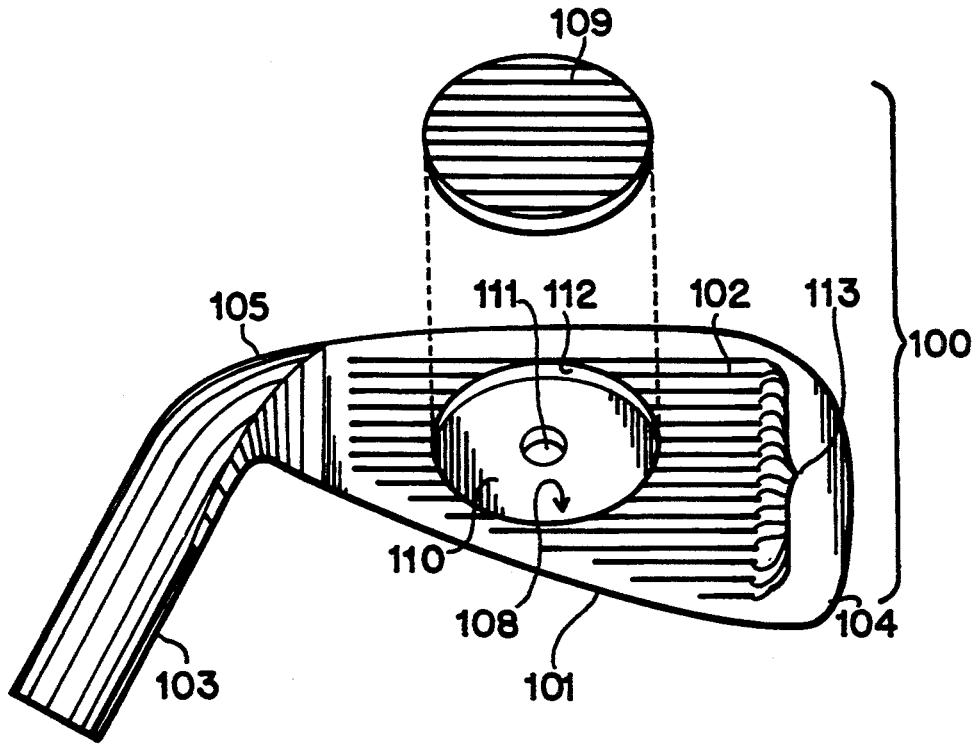
FIG. 14 is a partially exploded view of the golf club head.
Figure 15:
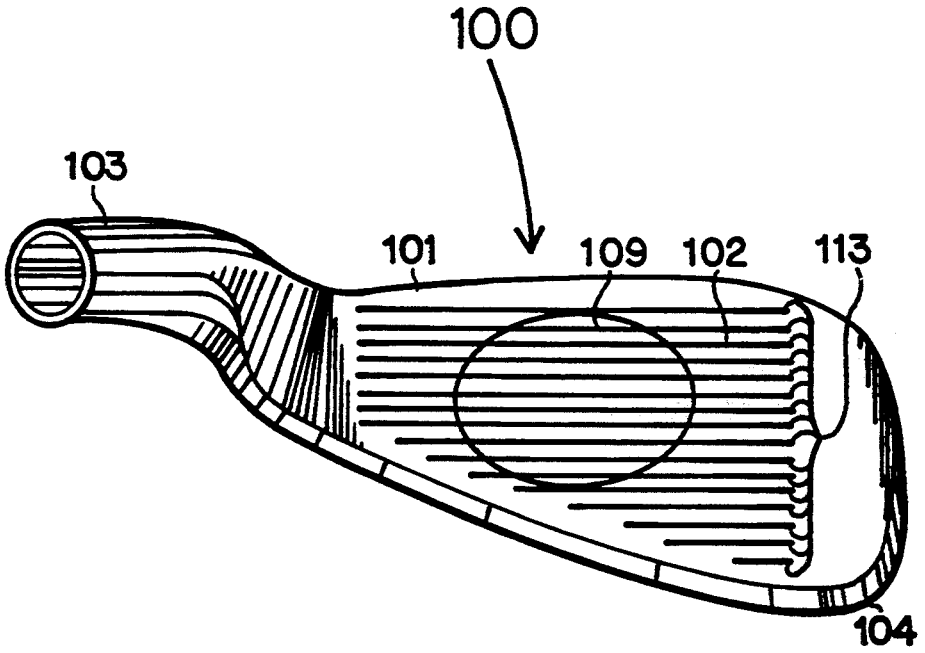
FIG. 15 is a top view of the golf club head.
Figure 16:
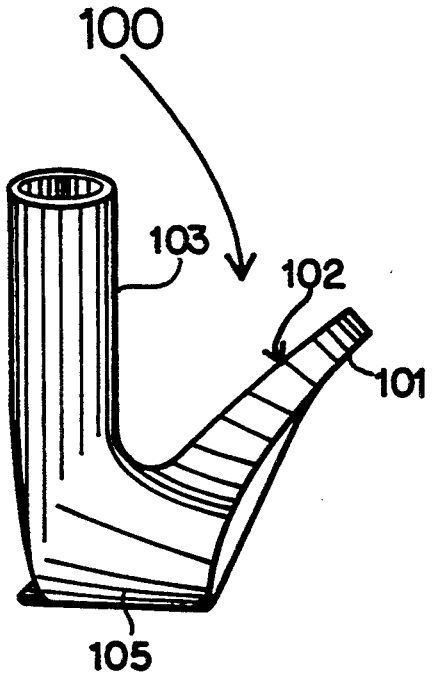
FIG. 16 is a right side view of the golf club head.
Figure 17:
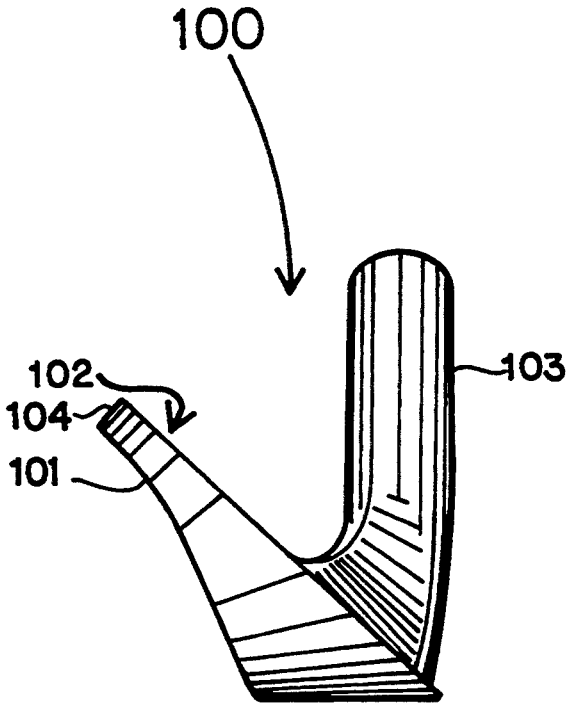
FIG. 17 is a left side view of the golf club head.
Figure 18:
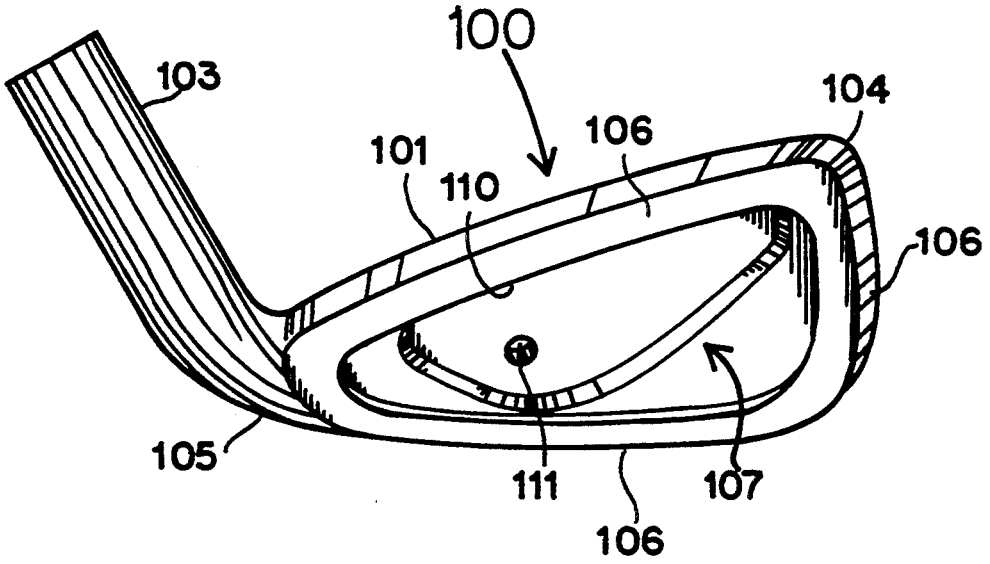
FIG. 18 is a back view of a golf club head showing the open cavity back.

FIG. 11 shows an asymmetrical insert which is the result of a recessed portion 108 which follows the perimeter shape of club face 102. Other asymmetrical inserts could include irregular polyhedrons and free form shapes.

A polymer filler material 109 is affixed within recessed portion 108 to form the insert. The forward facing surface of the insert is formed flush with club face 102 to form a continuous planar golf ball striking surface. A colored epoxy, sold under the tradename Epoweld TM 3243 Part A, is currently being successfully used to cast the insert. However, it is anticipated that a thermal polymer, such as Estaloc TM, will be molded into the recessed portion 108 using an injection molding technique. The primary characteristics necessary for filler material 109 are that it be a different material from that of the material used to fashion main body structure 101 so as to produce a different "feel" when the ball impacts the insert, that it exhibit elastic collision properties and that it be resilient to withstand high force impacts without deformation. Filler material 109 is also affixed within hollow cavity 107 in a similar manner.

Figure 4:
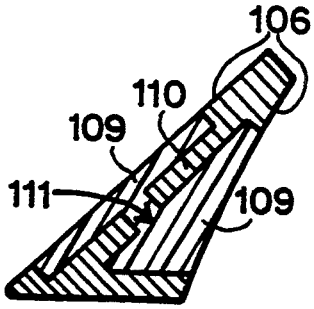
FIG. 4 is a right cross sectional view of a first embodiment of the golf club head shown in FIG. 2, the section being taken along section line 4—4 of FIG. 2.
Figure 5:
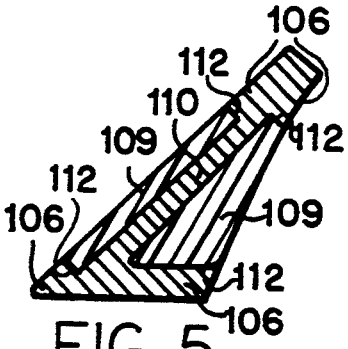
FIG. 5 is a right side section view of a second embodiment of the golf club head shown in FIG. 2 taken along section line 4—4.
Figure 6:
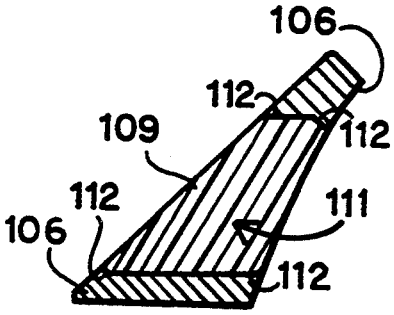
FIG. 6 is a right side section view of a third embodiment of the golf club head shown in FIG. 2 taken along section line 4—4.

A retainer is provided to facilitate retention of filler material 109 in both recess 108 and hollow cavity 107. In the first embodiment, specifically illustrated in FIGS. 4 and 14, a through hole 111 is provided in the back wall, here designated as retainer wall 110, which fluidly connects recessed portion 108 and hollow cavity 107. During manufacture, once main body structure 101 has been cast or otherwise formed, it is placed within a two sided mold, into which the filler material 109 is injected. Filler material 109 will displace all of the air occupying hollow cavity 107, through hole 111 and recessed portion 108, which when cured will form a club face insert and cavity filler which are mechanically coupled together and which will prevent one or the other from being displaced.

Through hole 111 is sized and shaped to prevent displacement of the filler material in the recessed portion through the through hole toward the cavity and to prevent displacement of the filler material in the cavity through the through hole toward the recessed portion. This is accomplished most simply by insuring that the cross sectional area of through hole 111 is less than that of either recessed portion 108 or hollow cavity 107. However, it is theoretically possible to design a through hole 111 which has a greater cross sectional area than that of recessed portion 108 and still prevent displacement of the insert through the through hole. For example, through hole 111 could be an elongated rectangle shape.

A second configuration for the retainer is to provide lips 112 protruding from the edges, at least two generally opposing edges, surrounding recessed portion 108 and likewise surrounding cavity 107.

A third configuration for the retainer is to provide a lip 112 protruding from an edge surrounding cavity 107 and a through hole 111 having a cross sectional area greater than that of the recessed portion 108, but less than that of hollow cavity 107. The smaller front opening of the recessed portion 108 prevents filler material 109 from being displaced forward out of club face 102 while lip 112 prevents filler material 109 from being displaced rearward out of cavity 107.

Grooves 113 are formed within filler material 109 to complete club face 102. Additionally, brand and model information can be conveniently placed or formed on the back surface of filler material in cavity 107.

In use, a golfer is able to perceive a solid feel when a golf ball is hit on the insert and a very different feel when a golf ball is contacted elsewhere on club face 102 because of the placement and shape of the insert, and because of the difference in materials. Heretofore, the perception of an off center hit by proficient golfers using low mass moment of inertia clubs was largely due to the induced twisting motion about the center of percussion. Now, these golfers are able to feel the off center hits without sacrificing either accuracy or distance. Additionally, judicious choices for both the color of filler material 109 and the shape of recessed portion 108 can help the golfer better visualize the impact area of the club and produce more consistent on center hits.

While there is shown and described the present preferred embodiment of the invention, it is to be distinctly understood that this invention is not limited thereto but may be variously embodied to practice within the scope of the following claims.

I claim:

1. A golf club which comprises:

a shaft having a grip attached thereto at a first end of the shaft;

a golf club head having a main body structure including a substantially flat club face wherein a substantial portion of the mass constituting the main body structure surrounds the marginal edges of the club face to form an empty cavity behind a striking surface of the club face, the club face having a recessed portion being substantially centrally located thereon;

filler material being of a different composition than that of the main body structure filling the recessed portion to form a continuous plane with the club face and filling the empty cavity; and a retainer interacting between the main body structure and the filler material to hold the filler material within the recessed portion and the cavity.

2. The golf club of claim 1 wherein the retainer comprises:

the recessed portion of the main body structure having a through hole extending from the recessed portion to the empty cavity;

the through hole being filled with filler material to structurally connect the filler material in the recessed portion to the filler material in the cavity; and the through hole being sized and shaped to prevent displacement of the filler material in the recessed portion through the through hole toward the cavity and to prevent displacement of the filler material in the cavity through the through hole toward the recessed portion.

3. The golf club of claim 1 wherein the retainer comprises:

a first lip protruding from an edge surrounding the recessed portion; and a second lip protruding from an edge surrounding the cavity.

4. The golf club of claim 1 wherein the retainer comprises:

a first lip protruding from an edge surrounding the cavity;

the recessed portion of the main body structure having a through hole extending from the recessed portion to the empty cavity;

the through hole being filled with filler material to structurally connect the filler material in the recessed portion to the filler material in the cavity.

5. A golf club head comprising:

a main body structure including a substantially flat club face wherein a substantial portion of the mass constituting the main body structure surrounds the marginal edges of the club face to form an empty cavity behind a striking surface of the club face, the club face having a recessed portion being substantially centrally located thereon;

filler material being of a different composition than that of the main body structure filling the recessed portion to form a continuous plane with the club face and filling the empty cavity; and a retainer interacting between the main body structure and the filler material to hold the filler material within the recessed portion and the cavity.

6. The golf club head of claim 5 wherein the retainer comprises:

the recessed portion of the main body structure having a through hole extending from the recessed portion to the empty cavity;

the through hole being filled with filler material to structurally connect the filler material in the recessed portion to the filler material in the cavity; and the through hole being sized and shaped to prevent displacement of the filler material in the recessed portion through the through hole toward the cavity and to prevent displacement of the filler material in the cavity through the through hole toward the recessed portion.

7. The golf club of claim 5 wherein the retainer comprises:

a first lip protruding from an edge surrounding the recessed portion; and a second lip protruding from an edge surrounding the cavity.

8. The golf club of claim 5 wherein the retainer comprises:

a first lip protruding from an edge surrounding the cavity;

the recessed portion of the main body structure having a through hole extending from the recessed portion to the empty cavity;

the through hole being filled with filler material to structurally connect the filler material in the recessed portion to the filler material in the cavity.

* * * * *